United States Patent [19]

Mitamura

[11] Patent Number: 4,509,866

[45] Date of Patent: Apr. 9, 1985

[54] WATERPROOF WATCHCASE WITH MULTI-LAYERED RESIN-COATED GLASS

[75] Inventor: Gen Mitamura, Tokyo, Japan

[73] Assignee: Seiko Instruments & Electronics Ltd., Tokyo, Japan

[21] Appl. No.: 577,862

[22] Filed: Feb. 7, 1984

[30] Foreign Application Priority Data

Feb. 7, 1983 [JP] Japan ..... 58-18512

[51] Int. Cl.[3] ..... G04B 37/00

[52] U.S. Cl. ..... 368/296

[58] Field of Search ..... 368/88, 291, 292, 294–296; 206/18, 301

[56] References Cited

U.S. PATENT DOCUMENTS

| | | | |
|---|---|---|---|
| 3,939,646 | 2/1976 | Uchiyama | 368/296 |
| 4,221,112 | 9/1980 | Enomoto et al. | 368/84 |
| 4,281,406 | 7/1981 | Tanaka | 368/88 |

FOREIGN PATENT DOCUMENTS

| | | | |
|---|---|---|---|
| 49-67663 | 7/1974 | Japan . | |
| 56-30668 | 3/1981 | Japan | 368/296 |
| 56-69575 | 6/1981 | Japan | 368/296 |
| 56-96267 | 8/1981 | Japan | 368/296 |

*Primary Examiner*—Vit W. Miska

*Attorney, Agent, or Firm*—Robert E. Burns; Emmanuel J. Lobato; Bruce L. Adams

[57] ABSTRACT

A waterproof watchcase-and-glass assembly has a plurality of superimposed resin layers coated on the glass in the region where the glass contacts the case to obtain a watertight connection between the case and glass. The innermost resin layer, which is in contact with the glass, has superior adhesion to glass and a lower hardness than the outermost resin layer, which is in contact with the case.

20 Claims, 12 Drawing Figures

WATERPROOF WATCHCASE WITH MULTI-LAYERED RESIN-COATED GLASS

BACKGROUND OF THE INVENTION

The present invention relates generally to a watchcase glass and more particularly to a technique for securing the glass to the watchcase to obtain a waterproof construction.

A glass of a watchcase has conventionally been secured to the case by adhesives. In recent years, a construction in which a glass is secured to a case by placing a plastic packing at a peripheral portion of the case and forcing the glass in the case with an interference fit has been mainly used for obtaining a waterproof watchcase.

FIG. 1A shows a sectional view of a conventional watchcase formed by the adhering method and FIG. 1B shows the shape of the glass used in the conventional watchcase. A glass 1 is adhered to a case 2 by adhering a glass-receiving surface 2S of a peripheral case portion 2A and an outer peripheral bottom surface 1S of the glass by adhesives. This method has been generally and widely used because of its extreme simplicity. This method, however, has rarely been used in connection with waterproof watches and has been used essentially only for non-waterproof watchcases because of the lack of strength of the adhesives, deterioration of the adhering force with elapsed time, and the inferiority in appearance due to the relatively large adhering area needed if used for a waterproof watchcase. Moreover, although the watchcase made by the adhering method is simple in construction, the manufacturing cost is not so inexpensive in view of the number of man-hours needed to take appropriate countermeasures to compensate for the useful life of the adhesives, temperature control, and for the swelling of the adhesives.

On the other hand, FIG. 2A shows a conventional watchcase formed by the force-fit method in which the glass 1 is forced in the case 2 using a plastic packing 3 and this method has recently been widely used for waterproof watches. FIG. 2B shows the shape of the glass 1 used in the conventional watchcase of FIG. 2A. This method has come into wide use because the plastic packing deteriorates less with elapsed time than adhesives and is easier to handle during the course of manufacture. However, the reduction in size and thickness of the watchcase is limited, as shown in FIG. 2C, because some width w and height h of the packing 3 are needed according to the molding conditions of the plastic packing and the arrangement of the plastic packing in the case. The width w of the packing should be 0.3–0.4 mm before assembly and 0.2–0.25 mm after assembly, and the height h should have a maximum value less than three times the value of w. If the height h is more than three times the width w, the assembling of the packing 3 becomes extremely difficult because the packing 3 may be flexed or pulled in the peripheral case portion 2A when the glass 1 is forced in the case 2.

SUMMARY OF THE INVENTION

This invention aims to eliminate the above-noted drawbacks and to provide a smaller and thinner waterproof watchcase. The principle of the invention is very simple—namely, a resin such as silicon, vinyl chloride, urethane, or the like is coated on the outer periphery of a glass to replace the conventional assembly of the glass and plastic packing. This basic idea is conventionally known and disclosed in, for instance, JITSUKAISHO 49-67663 (Utility model laid-open application No. 67663/74), as shown in FIG. 3.

Actually, however, the idea has not been put into practical use because of difficulties encountered with the coating resin, that is, the resin easily peels off and the waterproofness cannot be obtained. This invention improves upon the general idea disclosed in JITSUKAISHO 49-67663 to enable the idea to be put into practical use. Although an outline of a method for coating resin on a glass is illustrated in JITSUKAISHO 49-67663, no properties of the resin are specified. The method cannot be put into practical use simply by coating a resin on a glass. For example, when a sticky resin with close adherence to a glass is coated on the glass, the necessary hardness and elasticity cannot be obtained and the glass easily comes off the case. On the other hand, when a resin with high hardness is coated on the glass, the adherence to the glass is unsatisfactory and the resin tends to be scratched or scraped off when the glass is forced in the case.

The invention eliminates the drawbacks of the technique disclosed in JITSUKAISHA 49-67663 by laminating more than two layers of resin, with each two adjoining layers having different properties, on the glass.

DETAILED DESCRIPTION OF PREFERRED EMBODIMENTS

Figure 1A:
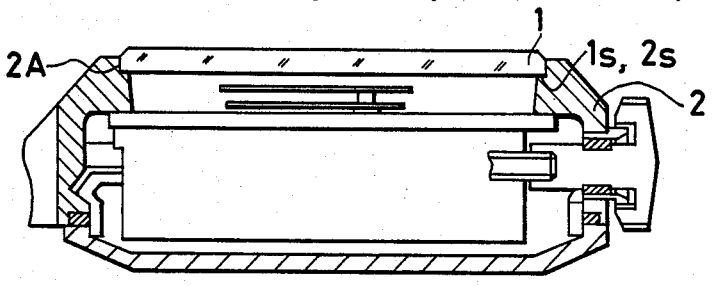
FIG. 1A (PRIOR ART)
FIGS. 1A and 1B show respectively a sectional view of a conventional now-waterproof watchcase and an elevational view of a glass.
Figure 1B:
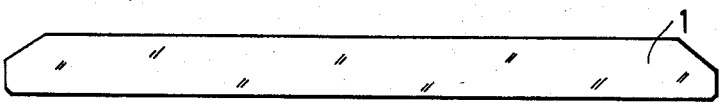
FIG. 1B (PRIOR ART)
Figure 2A:
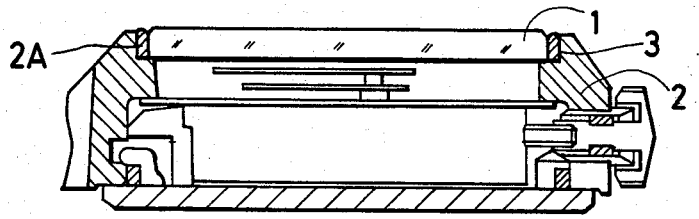
FIG. 2A (PRIOR ART)
FIGS. 2A and 2B show respectively a sectional view of a typical construction of a conventional waterproof watchcase and an elevational view of a glass.
Figure 2B:
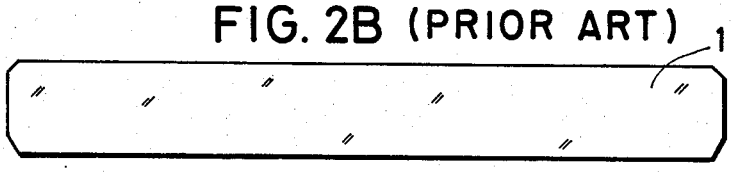
FIG. 2B (PRIOR ART)
Figure 2C:
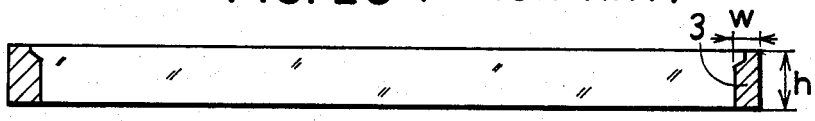
FIG. 2C (PRIOR ART)
FIG. 2C shows an explanatory view of a conventional glass and packing.
Figure 3:
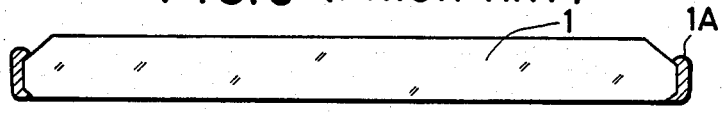
FIG. 3 (PRIOR ART)
FIG. 3 shows an explanatory view of a conventional resin-coated glass.
Figure 4:
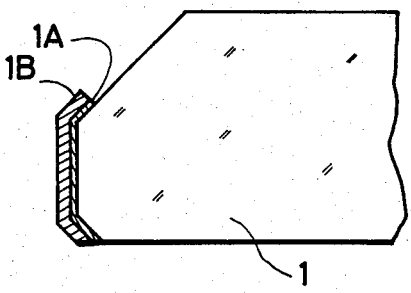
FIGS. 4 and 5 are fragmentary sectional views of a multi-layered resin-coated glass according to embodiments of the present invention.

FIG. 4 shows a fragmentary section of a resin-coated portion of a galss 1. Initially, a first layer of resin 1A having the property of high adherence to glass, such as silicon or urethane, is uniformly coated on the edge of the outer periphery of the glass 1 at a thickness of less than 0.1 mm by spraying, printing or copying.

After drying the first layer, a second layer of resin 1B is coated on the first layer 1A. The resin of the second layer preferably has the properties of moderate elasticity and high strength, such as polyethylene, polyprophlene, or the like. The second layer 1B is coated at a thickness of 0.2–0.3 mm in the form of a monomer and then polymerized by heat or by chemical reaction. It is desirable that the second layer is formed by a method which enables a thick layer to be coated, such as roller coating, copying, or offset printing.

Figure 7A:
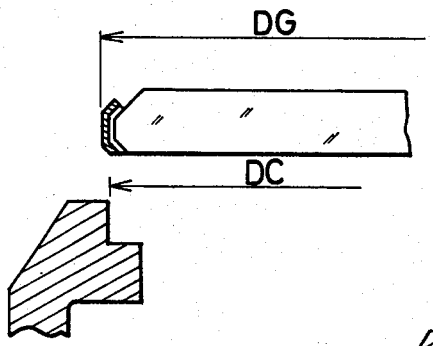
FIGS. 7A,7B and 8 are explanatory views showing the relative dimensions of a multi-layered resin-coated glass and glass-receiving portion of a watchcase according to the present invention.
Figure 7B:
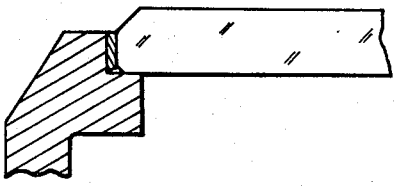

The multi-layered resin-coated glass made by the above method is forced in the case with the case diameter DC of the peripheral case portion being smaller by 0.1–0.4 mm than the outer diameter DG of the resin-coated glass as shown in FIG. 7A, and then set as shown in FIG. 7B to be used as a waterproof case. Since, however, there is a probability that the resin may be peeled to some extent when the resin is laminated in two layers, the resin is laminated in three layers as shown in FIG. 5 to further enhance the quality.

Figure 5:
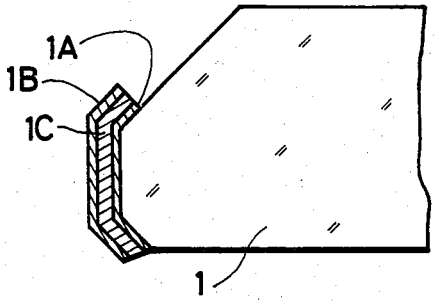
Figure 6:
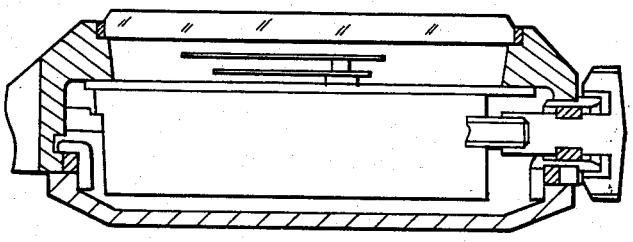
FIG. 6 is a sectional view of a waterproof watchcase using a multi-layered resin-coated glass according to the present invention.

In FIG. 5, a material 1C having the properties of lower hardness and higher elastic restoring force than the layer 1B, such as urethane in synthetic rubber, nylon, or synthetic rubber, is laminated between the outside layer 1B and the inside layer 1A. By the above composition of the layers, a composite resin coating with both elasticity and hardness can be provided on the glass to provide a durable waterproof structure.

Figure 8:
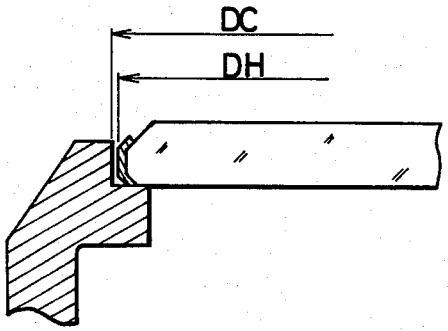

According to another embodiment, a mixture of a recently-developed and micro-capsulated vesicant and a resin can be used for watertightly sealing and fixing the glass in the case. A vesicating resin is coated on the outside layer 1B of the structure shown in FIG. 4. In this case, the coated layer can be made thinner by an amount corresponding to the volume added by vesication of the resin. The outer diameter DH of the resin-coated glass is made smaller than the case diameter DC of the peripheral case portion as shown in FIG. 8, i.e., DC>DH, and preferably DC-DH is in the range 0.05–0.1 mm. Thus, in this embodiment there is no need to force the glass in the case and the resin surface does not become damaged and the glass is set in the case in an ideal state. After that, the case is heated to 50°–150° C., and then the vesicant is disintegrated and the volume of the resin is expanded. As a result, the case and the glass are brought to the same state as shown in FIG. 7B, and the glass 1 is secured to the case 2 with tight waterproofness.

According to the present invention, a thin and small waterproof watchcase is realized very simply. By applying this method to the adhesion of a glass of a non-waterproof watchcase, unsatisfactory adhesion of the glass to the case can be eliminated and the manufacturing cost reduced. Further, a metal mold used for molding the conventional plastic packing 3 by injection molding is not needed in the method of the present invention since the watchcase does not require use of such a packing. In post-sales servicing, the number of parts which need be kept in stock is reduced since a packing is not needed. Moreover, the useful life and swelling of adhesives, which greatly affect the waterproof function of the prior art watchcases, is of no concern to the waterproof capabilities of the watchcase constructed according to the present invention.

I claim:

1. A watchcase having a glass mounted thereon, the glass having an outer peripheral portion coated with more than two superimposed layers of resin of different hardness.

2. A watchcase as claimed in claim 1, wherein the innermost layer of resin which is nearest the glass has superior adhesion to glass and lower hardness as compared to the outermost layer of resin.

3. A watchcase as claimed in claim 2, wherein the outermost layer of resin contains temperature-sensitive vesicants.

4. A watchcase as claimed in claim 3, wherein the outer diameter of the resin-coated glass is initially made smaller than the inner diameter of the watchcase at the portion thereof on which the glass is mounted so that when the glass is mounted on the watchcase and heated at a temperature of 50° C.–150° C. to vesicate the vesicants, the volume of the outermost layer of resin expands and presses against the watchcase to tightly secure the glass to the watchcase with tight waterproofness.

5. A watchcase as claimed in claim 2, wherein the outer diameter of the non-coated glass is smaller than the inner diameter of the watchcase at the portion thereof on which the glass is mounted, the outermost diameter of the resin-coated glass is larger than the said inner diameter of the watchcase, and the resin-coated glass being forced in the watchcase and secured thereto with an interference fit so that the glass is secured to the watchcase with tight waterproofness.

6. A watchcase as claimed in claim 1, wherein a first layer nearest to the glass is composed of a resin with superior adhesion to the glass, a second layer is composed of a resin with high elastic restoring force, and an outermost third layer is composed of a resin with higher hardness than the first and second layers.

7. A watchcase as claimed in claim 6, wherein the outer diameter of the non-coated glass is smaller than the inner diameter of the watchcase at the portion thereof on which the glass is mounted, the outermost diameter of the resin-coated glass is larger than the said inner diameter of the watchcase, and the resin-coated glass being forced in the watchcase and secured thereto with an interference fit so that the glass is secured to the watchcase with tight waterproofness.

8. A waterproof watchcase-and-glass assembly comprising: a watchcase having a recessed case portion for receiving a glass; a glass disposed on the recessed case portion; and means including a plurality of superimposed layers of resin coated on a peripheral portion of the glass in the region where the glass contacts the watchcase for watertightly securing the glass to the watchcase to thereby define a waterproof watchcase-and-glass assembly.

9. A waterproof watchcase-and-glass assembly as claimed in claim 8; wherein each two adjoining resin layers have different properties.

10. A waterproof watchcase-and-glass assembly as claimed in claim 8; wherein the innermost resin layer which contacts the glass has superior adhesion to the glass and lower hardness than the outermost resin layer.

11. A waterproof watchcase-and-glass assembly as claimed in claim 10; wherein the plurality of superimposed resin layers includes an intermediate resin layer between the innermost and outermost resin layers, the intermediate resin layer having a lower hardness than the outermost resin layer.

12. A waterproof watchcase-and-glass assembly as claimed in claim 11; wherein the intermediate resin layer has a higher elasticity than the outermost resin layer.

13. A waterproof watchcase-and-glass assembly as claimed in claim 10; wherein the outermost resin layer is comprised of a mixture of resin and vesicant.

14. A waterproof watchcase-and-glass assembly as claimed in claim 8; wherein the means for watertightly securing the glass to the watchcase comprises an interference fit between the resin-coated glass and the recessed case portion of the watchcase without use of a packing.

15. A method for producing a waterproof watchcase-and-glass assembly comprising the steps of: providing a glass and a watchcase having a recessed case portion for receiving the glass; successively coating layers of resin on a peripheral portion of the glass in the region where the glass is to contact the recessed case portion of the watchcase; and disposing the resin-coated glass directly on the recessed case portion to watertightly secure the glass to the watchcase without use of a packing.

16. A method according to claim 15; wherein the disposing step comprises disposing the resin-coated glass directly on the recessed case portion with an interference fit effective to obtain a waterproof seal between the glass and the watchcase.

17. A waterproof watchcase-and-glass assembly as claimed in claim 15; wherein the coating step includes coating the glass with an outermost layer of resin which has mixed therein an expandable vesicant; and the disposing step comprises dispensing the resin-coated glass directly on the recessed case portion with a loose fit, and then heating the watchcase and glass to effect expansion of the vesicant accompanied by expansion of the outermost resin layer to a degree sufficient to watertightly secure the glass to the watchcase.

18. A waterproof watchcase-and-glass assembly as claimed in claim 17; wherein the heating is carried out at a temperature in the range 50° C.–150° C.

19. A waterproof watchcase-and-glass assembly as claimed in claim 15; wherein the coating step comprises coating the glass with an innermost resin layer having superior adhesion to the glass and lower hardness than a subsequently coated outermost resin layer.

20. A waterproof watchcase-and-glass assembly as claimed in claim 15; wherein the coating step comprises coating the glass with a plurality of resin layers with each two adjoining resin layers having different properties.

* * * * *